US011081785B2

(12) United States Patent
Lyu

(10) Patent No.: US 11,081,785 B2
(45) Date of Patent: Aug. 3, 2021

(54) ANTENNA MODULE

(71) Applicants: Inventec (Pudong) Technology Corporation, Shanghai (CN); INVENTEC CORPORATION, Taipei (TW)

(72) Inventor: Chao-An Lyu, Taipei (TW)

(73) Assignees: Inventec (Pudong) Technology Corporation, Shanghai (CN); INVENTEC CORPORATION, Taipei (TW)

( * ) Notice: Subject to any disclaimer, the term of this patent is extended or adjusted under 35 U.S.C. 154(b) by 90 days.

(21) Appl. No.: 16/712,965

(22) Filed: Dec. 12, 2019

(65) Prior Publication Data

US 2021/0151871 A1 May 20, 2021

(30) Foreign Application Priority Data

Nov. 15, 2019 (CN) ..... 201911120549.3

(51) Int. Cl.
*H01Q 1/48* (2006.01)
*H01Q 9/42* (2006.01)
*H01Q 9/16* (2006.01)

(52) U.S. Cl.
CPC ..... *H01Q 1/48* (2013.01); *H01Q 9/16* (2013.01); *H01Q 9/42* (2013.01)

(58) Field of Classification Search
CPC .. H01Q 1/48; H01Q 9/16; H01Q 9/42; H01Q 5/0062; H01Q 5/0065; H01Q 5/0068; H01Q 5/0089
See application file for complete search history.

(56) References Cited

U.S. PATENT DOCUMENTS

2018/0006369 A1* 1/2018 Higaki ..... H01Q 3/247

* cited by examiner

*Primary Examiner* — Graham P Smith
(74) *Attorney, Agent, or Firm* — CKC & Partners Co., LLC

(57) ABSTRACT

An antenna module includes a grounding conductor, a first radiator, a second radiator, and a grounding component. The grounding conductor has a grounding function. The first radiator includes a first feeding portion and a first radiating portion. The second radiator includes a second feeding portion and a second radiating portion. The grounding component is located between the first radiator and the second radiator, and includes a first coupling portion, a second coupling portion, a capacitor, and a first grounding portion. The first radiating portion is spaced apart from the first coupling portion and the second radiating portion is spaced apart from the second coupling portion. The capacitor is located among the first coupling portion, the second coupling portion, and the first grounding portion. The first grounding portion is connected to the grounding conductor.

9 Claims, 3 Drawing Sheets

ANTENNA MODULE

CROSS-REFERENCE TO RELATED APPLICATION

This application claims priority to China Application Serial Number 201911120549.3, filed Nov. 15, 2019, which is herein incorporated by reference in its entirety.

BACKGROUND

Field of Invention

The present disclosure relates to an antenna module, and more particularly, to an antenna module with a good isolation function.

Description of Related Art

It is known that dual antennas with the same operating frequency band have poor isolation. As a result, the two antennas must be spaced by a distance of more than a quarter wavelength of the operating frequency band of the antennas.

Therefore, research in various industries has been focused on ways to develop an innovative dual antenna module which improves isolation between the two antennas thereof to allow for the miniaturization of a communication device equipped with such an antenna module.

SUMMARY

An aspect of the disclosure is to provide an antenna module which can effectively solve the aforementioned problems.

According to an embodiment of the present disclosure, an antenna module includes a grounding conductor, a first radiator, a second radiator, and a grounding component. The grounding conductor has a grounding function. The first radiator includes a first feeding portion and a first radiating portion. The second radiator includes a second feeding portion and a second radiating portion. The grounding component is located between the first radiator and the second radiator, and the grounding component includes a first coupling portion, a second coupling portion, a capacitor, and a first grounding portion. The first radiating portion is spaced apart from the first coupling portion and the second radiating portion is spaced apart from the second coupling portion. The capacitor is located among the first coupling portion, the second coupling portion, and the first grounding portion, wherein the first grounding portion is connected to the grounding conductor.

In an embodiment of the disclosure, the capacitor is a chip capacitor, a distributed capacitor, or a lumped capacitor.

In an embodiment of the disclosure, the first radiating portion is radiationally coupled with the first coupling portion and the second radiating portion is radiationally coupled with the second coupling portion.

In an embodiment of the disclosure, a distance between the first radiating portion and the first coupling portion is equal to or less than 1 mm and a distance between the second radiating portion and the second coupling portion is equal to or less than 1 mm.

In an embodiment of the disclosure, the first radiator and the second radiator are substantially L-shaped, and the grounding component is substantially T-shaped.

In an embodiment of the disclosure, the first radiating portion further includes a first free end and the second radiating portion further includes a second free end, wherein the first free end and the second free end extend away from each other.

In another embodiment of the disclosure, the first radiator further includes a second grounding portion and the second radiator further includes a third grounding portion, wherein the grounding conductor is connected to the second grounding portion and the third grounding portion.

In another embodiment of the disclosure, the first radiator and the second radiator are substantially F-shaped, and the grounding component is substantially T-shaped.

In another embodiment of the disclosure, the first radiating portion further includes a first free end and the second radiating portion further includes a second free end, wherein the first free end and the second free end respectively extend toward opposite directions.

In another embodiment of the disclosure, resonance frequencies of the first radiator and the second radiator are approximately 5 GHz, and a resonance frequency of the grounding component is approximately 2.4 GHz.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
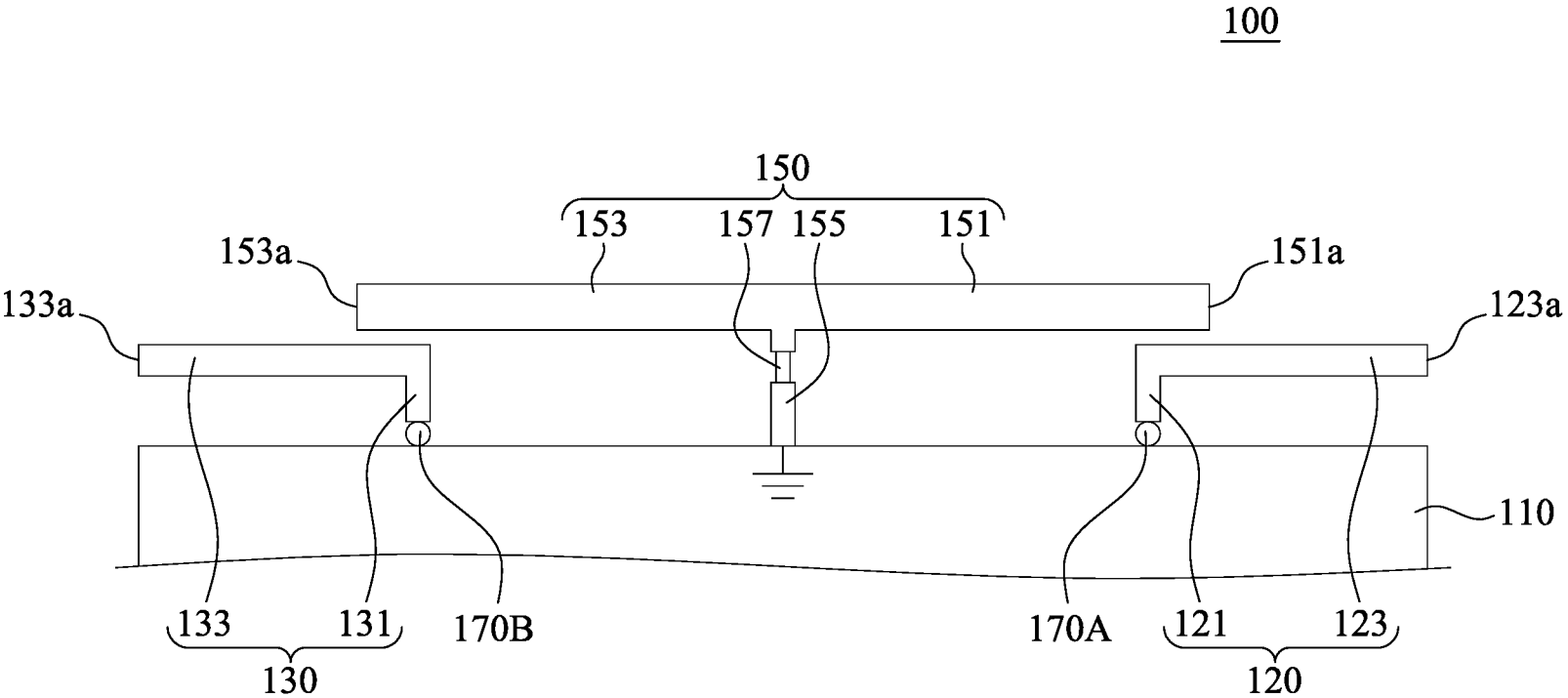
FIG. 1 is an equivalent schematic diagram of the first embodiment of the present invention.

Reference will now be made in detail to the present embodiments of the disclosure, examples of which are illustrated in the accompanying drawings. Wherever possible, the same reference numbers are used in the drawings and the description to refer to the same or like parts.

In various embodiments, description is made with reference to figures. However, certain embodiments may be practiced without one or more of these specific details, or in combination with other known methods and configurations. In the following description, numerous specific details are set forth, such as specific configurations, dimensions and processes, etc., in order to provide a thorough understanding of the present disclosure. Reference throughout this specification to "one embodiment," "an embodiment", "some embodiments" or the like means that a particular feature, structure, configuration, or characteristic described in connection with the embodiment is included in at least one embodiment of the disclosure. Thus, the appearances of the phrase "in one embodiment," "in an embodiment", "in some embodiments" or the like in various places throughout this specification are not necessarily referring to the same embodiment of the disclosure. Furthermore, the particular features, structures, configurations, or characteristics may be combined in any suitable manner in one or more embodiments.

Reference is made to FIG. 1. In the first embodiment of the present disclosure, an antenna module 100 includes a grounding conductor 110, a first radiator 120, a second radiator 130, and a grounding component 150. The grounding conductor 110 has a grounding function. The first radiator 120 includes a first feeding portion 121 and a first radiating portion 123. The second radiator 130 includes a second feeding portion 131 and a second radiating portion 133. The grounding component 150 is located between the first radiator 120 and the second radiator 130, and the grounding component 150 includes a first coupling portion 151, a second coupling portion 153, a first grounding portion 155, and a capacitor 157. The first radiating portion 123 is spaced apart from the first coupling portion 151 and the second radiating portion 133 is spaced apart from the second coupling portion 153. The capacitor 157 is located among the first coupling portion 151, the second coupling portion 153, and the first grounding portion 155, and the first grounding portion 155 is connected to the grounding conductor 110.

In the first embodiment, the first radiator 120, the second radiator 130, and the grounding component 150 are disposed on one side of the grounding conductor 110. The first radiator 120 further incudes a first free end 123*a*. One end of the first radiator 120 electrically connected to a first signal source 170A is the first feeding portion 121, and another end thereof remote from the first signal source 170A is the first free end 123*a*. A bend is formed between the first feeding portion 121 and the first free end 123*a*, and the first radiating portion 123 is defined starting from the first feeding portion 121 and extending to the first free end 123*a*. That is, the first radiator 120 and the first radiating portion 123 are substantially L-shaped.

In the first embodiment, the second radiator 130 further incudes a second free end 133*a*. One end of the second radiator 130 electrically connected to a second signal source 1708 is the second feeding portion 131, and another end thereof remote from the second signal source 1708 is the second free end 133*a*. A bend is formed between the second feeding portion 131 and the second free end 133*a*, and the second radiating portion 133 is defined starting from the second feeding portion 131 and extending to the second free end 133*a*. That is, the second radiator 130 and the second radiating portion 133 are substantially L-shaped.

In the first embodiment, the first free end 123*a* and the second free end 133*a* can extend away from the grounding component 150. Therefore, the first free end 123*a* and the second free end 133*a* respectively extend toward opposite directions. However, the present disclosure is not limited in this respect, and the first free end 123*a* and the second free end 133*a* may extend toward a specific direction or toward each other according to user requirements.

In the first embodiment, the first coupling portion 151 and the second coupling portion 153 of the grounding component 150 extend to the first grounding portion 155 passing through the capacitor 157, and the first coupling portion 151 and the second coupling portion 153 extend to opposite sides of the first grounding portion 155. The grounding component 150 further includes a first end 151*a* and a second end 153*a*. An end of the first coupling portion 151 located away from the first grounding portion 155 is the first end 151*a*, and an end of the second coupling portion 153 located away from the first grounding portion 155 is the second end 153*a*.

A bend is formed between the first grounding portion 155 and the first end 151*a*. A bend is formed between the first grounding portion 155 and the second end 153*a*. Therefore, the grounding component 150 is substantially T-shaped. The first grounding portion 155 is located at the central axis of the T-shaped grounding component 150 to connect to the grounding conductor 110.

Specifically, the first coupling portion 151 is defined starting from the first end 151*a* and extending to the first grounding portion 155, and the second coupling portion 153 is defined starting from the second end 153*a* and extending to the first grounding portion 155. In the present embodiment, the position of the capacitor 157 can be decided according to requirements. The capacitor 157 can be located at a position close to the first end 151*a*, and the capacitor 157 can also be located at a position close to the second end 153*a*. However, the present disclosure is not limited in this respect. In some embodiments, the capacitor 157 is located at the central axis of the T-shaped grounding component 150.

In the first embodiment, the first signal source 170A and the second signal source 170B respectively feed signals to the first feeding portion 121 and the second feeding portion 131. Moreover, the first radiating portion 123 and the first coupling portion 151 are spaced by an interval so as to be mutually radiationally coupled, and the second radiating portion 133 and the second coupling portion 153 are spaced by an interval so as to be mutually radiationally coupled. Therefore, the first radiator 120 and the second radiator 130 can acquire additional radiating paths in order to be applicable in additional frequency bands.

"Radiationally coupled" in the present disclosure refers to the phenomenon in which when a radiating part approaches an object (a conductor generally), a signal path is generated from a signal feeding point through a radiationally coupling point to the ground.

Specifically, the first radiating portion 123 is spaced from the first coupling portion 151 by a distance of equal to or less than 1 mm, and the second radiating portion 133 is spaced from the second coupling portion 153 by a distance of equal to or less than 1 mm so as to acquire a better effect of radiationally coupling.

In the first embodiment, the capacitor 157 is configured to maintain isolation between the first radiator 120 and the second radiator 130. Depending on user requirements, the capacitor 157 may be a chip capacitor, a distributed capacitor, or a lumped capacitor. The capacitor 157 may also be replaced by a band-rejection circuit, so that the isolation effect is better when the grounding component 150 is applied in specific frequency-bands, but the present disclosure is not limited in this respect.

Figure 2:
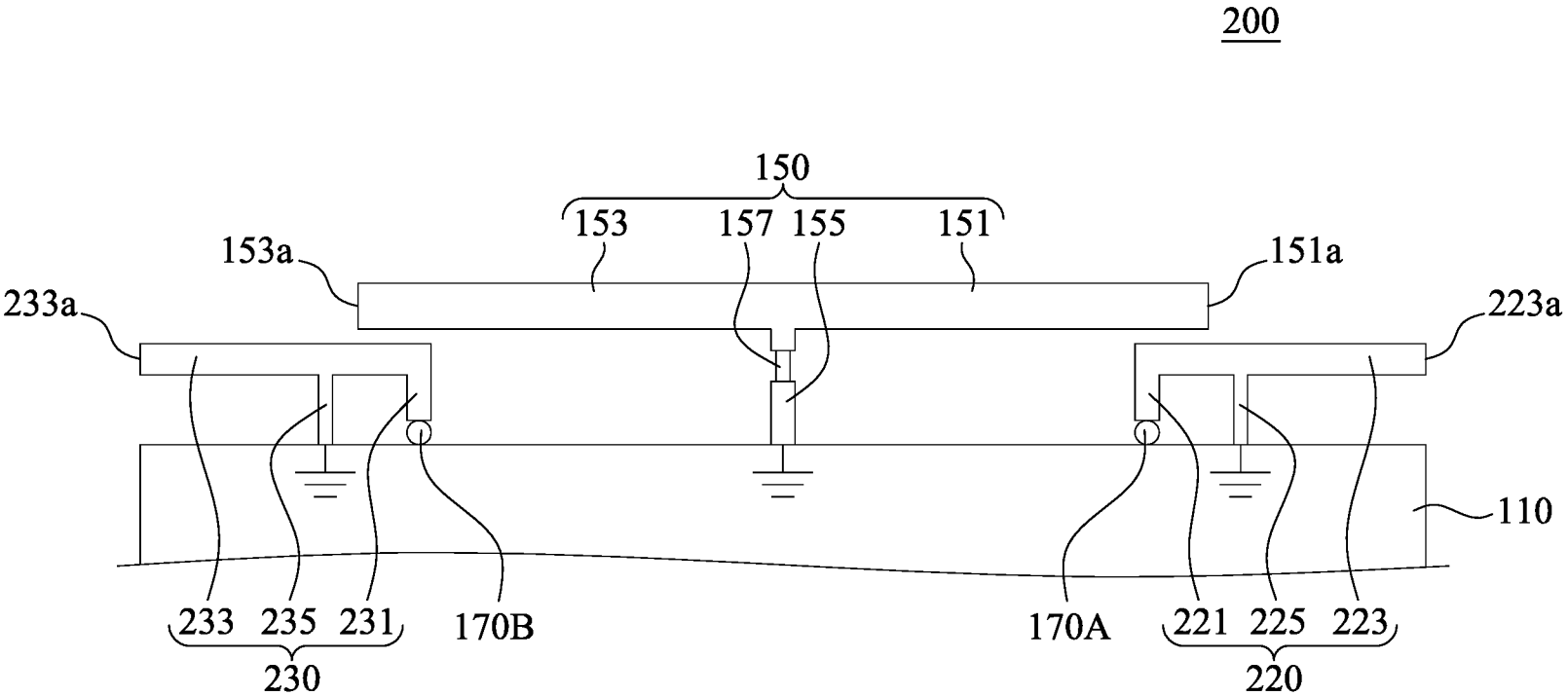
FIG. 2 is an equivalent schematic diagram of the second embodiment of the present invention.

Reference is now made to FIG. 2. FIG. 2 illustrates the second embodiment of the present invention. Compared with the first embodiment, the first radiator 220 of the antenna module 200 further includes a second grounding portion 225. Moreover, the second radiator 230 of the antenna module 200 further includes a third grounding portion 235. The second grounding portion 225 extends from the first radiating portion 223 toward the grounding conductor 110 to connect to the grounding conductor 110. Similarly, the third grounding portion 235 extends from the second radiating portion 233 toward the grounding conductor 110 to connect to the grounding conductor 110. The first feeding portion 221 and the second grounding portion 225 are located on the same side of the first radiating portion 223. The second feeding portion 231 and the third ground portion 235 are located on the same side of the second radiating portion 233.

In the second embodiment, an end of the first radiating portion 223 located away from the first feeding portion 221 and the second grounding portion 225 is a first free end 223*a*. An end of the second radiating portion 233 located away from the second feeding portion 231 and the third grounding portion 235 is a second free end 233*a*. The first free end 223*a* and the second free end 233*a* extend toward opposite directions, but the present disclosure is not limited in this respect. The first free end 223*a* and the second free end 233*a* can extend toward each other or a specific direction according to requirements.

As shown in FIG. 2, the first radiating portion 223 is defined starting from the first free end 223*a* and extending to the first feeding portion 221 and the second grounding portion 225. A bend is formed between the first feeding portion 221 and the first free end 223*a* and a bend is formed between the second grounding portion 225 and the first free end 223*a*, so that the first radiator 220 is substantially F-shaped. The second radiating portion 233 is defined starting from the second free end 233*a* and extending to the second feeding portion 231 and the third grounding portion 235. A bend is formed between the second feeding portion 231 and the second free end 233*a* and a bend is formed between the third grounding portion 235 and the second free end 233*a*, so that the second radiator 230 is substantially F-shaped.

In the second embodiment, the first coupling portion 151 and the second coupling portion 153 of the grounding component 150 extend to the first grounding portion 155 through the capacitor 157. The first coupling portion 151 and the second coupling portion 153 respectively extend toward opposite sides of the first grounding portion 155. The grounding component 150 further includes a first end 151*a* and a second end 153*a*, wherein an end of the first coupling portion 151 located away from the first grounding portion 155 is the first end 151*a* and an end of the second coupling portion 153 located away from the first grounding portion 155 is the second end 153*a*. A bend is formed between the first grounding portion 155 and the first end 151*a* of the first coupling portion 151, and a bend is formed between the first grounding portion 155 and the second end 153*a* of the second coupling portion 153. Therefore, the grounding component 150 is substantially T-shaped, and the first grounding portion 155 is located at the central axis of the T-shaped grounding component 150 to connect to the grounding conductor 110.

Specifically, the first coupling portion 151 is defined starting from the first end 151*a* and extending to the first grounding portion 155, and the second coupling portion 153 is defined starting from the first end 151*a* and extending to the first grounding portion 155. In the present disclosure, the location of the capacitor 157 can be decided according to requirements. The capacitor 157 can be located at a position close to the first end 151*a*, and the capacitor 157 can also be located at a position close to the second end 153*a*. The present disclosure is not limited in this respect. In some embodiments, the capacitor 157 is located at the central axis of the T-shaped grounding component 150.

In the second embodiment, the first signal source 170A and the second signal source 170B respectively feed signals to the first feeding portion 121 and the second feeding portion 131. Moreover, the first radiating portion 223 and the second radiating portion 233 are mutually radiationally coupled with the first coupling portion 151 and the second coupling portion 153. Therefore, the first radiating portion 223 and the second radiating portion 233 can acquire additional radiating paths in order to be applicable in additional frequency bands.

Specifically, the first radiating portion 223 is spaced from the first coupling portion 151 by a distance of equal to or less than 1 mm, and the second radiating portion 233 is spaced from the second coupling portion 153 by a distance of equal to or less than 1 mm, thereby acquiring a better effect of radiationally coupling.

In the second embodiment, the capacitor 157 is configured to maintain isolation between the first radiator 220 and the second radiator 230. Depending on user requirements, the capacitor 157 may be a chip capacitor, a distributed capacitor, or a lumped capacitor.

Moreover, the capacitor 157 may also be replaced by a band-rejection circuit, so that the isolation effect is better when the grounding component 150 is applied in specific frequency-bands (such as the 2.4 GHz frequency band), but the present disclosure is not limited in this respect.

In the second embodiment, the first radiator 220 and the second radiator 230 can be 5 GHz frequency band antennas and the grounding component 150 can be a 2.4 GHz frequency band antenna.

Figure 3:
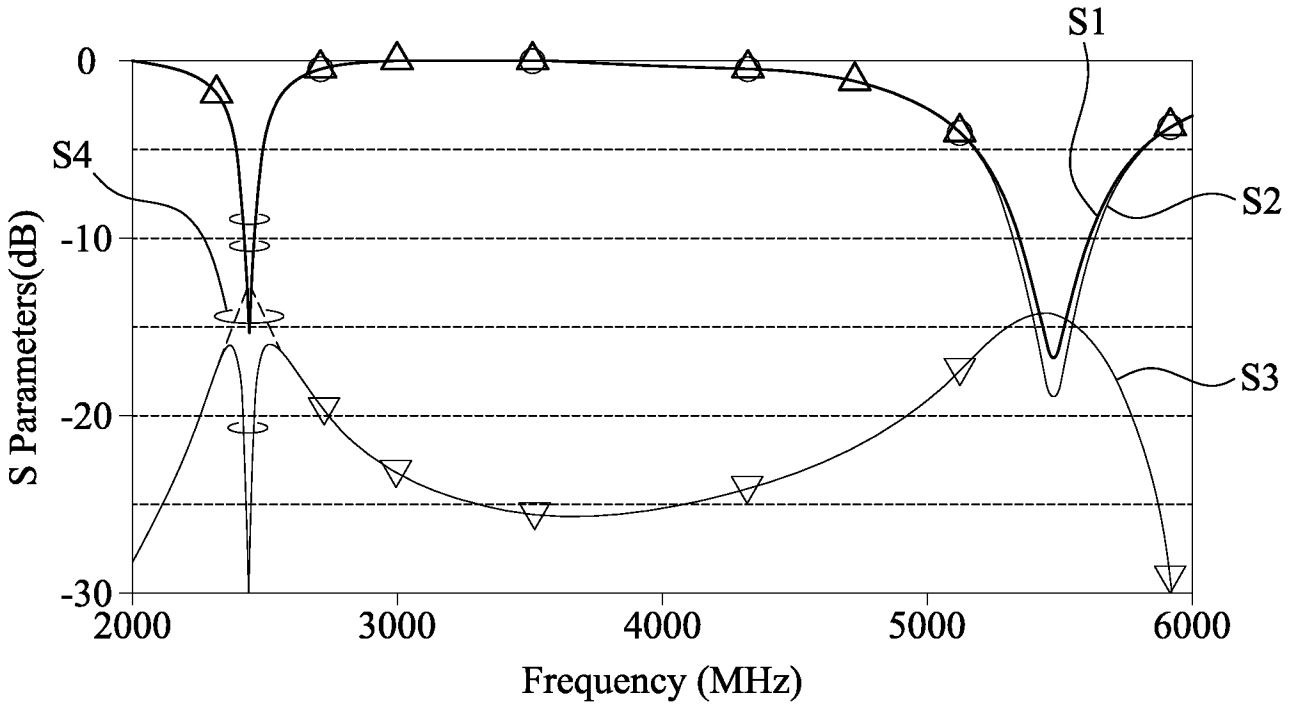
FIG. 3 is a comparison diagram of return loss for the embodiment shown in FIG. 2.

Reference is now made to FIG. 3. FIG. 3 is a comparison diagram of return loss for the embodiment shown in FIG. 2. The curve S1 is a return loss diagram of the first feeding portion 221 of the first radiator 220. The curve S2 is a return loss diagram of the second feeding portion 231 of the second radiator 230. The curve S1 and the curve S2 are substantially the same, and the difference occurs only in about the 5.5 GHz frequency band. The curves S1 and S2 obviously show that the first radiator 220 and the second radiator 230 can be applied in multiple frequency bands.

Curve S3 represents the isolation between the first radiator 220 and the second radiator 230 with the capacitor 157. Curve S4 (shown by a dotted line) represents the isolation between the first radiator 220 and the second radiator 230 without the capacitor 157. As is evident from curve S3, there is good isolation between the first radiator 220 and the second radiator 230. In contrast, as is evident from curve S4, there is poor isolation between the first radiator 220 and the second radiator 230. As can be known from a comparison between curve S3 and curve S4, the capacitor 157 provides for superior isolation between the first radiator 220 and the second radiator, so that the interval between the first radiator 220 and the second radiator 230 can be reduced, thereby allowing for miniaturization of the antenna module 200.

In summary, both the first radiator and the second radiator in the present disclosure are radiationally coupled with the grounding component, and the first radiator and the second radiator may be spaced by an interval less than a quarter wavelength of the operating frequency band. Moreover, the grounding component further includes a capacitor. With the configuration of the capacitor, good isolation between the first radiator and the second radiator can be maintained, thereby allowing for miniaturization of a dual antenna module.

What is claimed is:

1. An antenna module, comprising:

a grounding conductor with grounding function;

a first radiator comprising a first feeding portion and a first radiating portion;

a second radiator comprising a second feeding portion and a second radiating portion; and a grounding component located between the first radiator and the second radiator comprising a first coupling portion, a second coupling portion, a capacitor, and a first grounding portion, wherein the first radiating portion is spaced apart from the first coupling portion and the second radiating portion is spaced apart from the second coupling portion, and the capacitor is located among the first coupling portion, the second coupling portion, and the first grounding portion, wherein the first grounding portion is connected to the grounding component, a distance between the first radiating portion and the first coupling portion is shorter than 1 mm and a distance between the second radiating portion and the second coupling portion is shorter than 1 mm.

2. The antenna module of claim 1, wherein the capacitor is a chip capacitor, a distributed capacitor, or a lumped capacitor.

3. The antenna module of claim 1, wherein the first radiating portion is radiationally coupled with the first coupling portion and the second radiating portion is radiationally coupled with the second coupling portion.

4. The antenna module of claim 1, wherein the first radiating portion and the second radiating portion are substantially L-shaped, and the grounding component is substantially T-shaped.

5. The antenna module of claim 4, the first radiating portion further comprising a first free end and the second radiating portion further comprising a second free end, wherein the first free end and the second free end respectively extend toward opposite directions.

6. The antenna module of claim 4, the first radiator further comprising a second grounding portion and the second radiator further comprising a third grounding portion, wherein the grounding conductor is connected to the second grounding portion and the third grounding portion.

7. The antenna module of claim 6, wherein the first radiating portion and the second radiating portion are substantially F-shaped, and the grounding component is substantially T-shaped.

8. The antenna module of claim 7, the first radiating portion further comprising a first free end and the second radiating portion further comprising a second free end, wherein the first free end and the second free end respectively extend toward opposite directions.

9. The antenna module of claim 6, wherein resonance frequencies of the first radiator and the second radiator are approximately 5 GHz, and a resonance frequency of the grounding component is approximately 2.4 GHz.

* * * * *